US008531338B2

(12) United States Patent
Ma et al.

(10) Patent No.: US 8,531,338 B2
(45) Date of Patent: Sep. 10, 2013

(54) WIRELESS COMMUNICATION DEVICE

(75) Inventors: Chin-Hung Ma, Taoyuan (TW); Chi-Sheng Liu, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 576 days.

(21) Appl. No.: 12/819,291

(22) Filed: Jun. 21, 2010

(65) Prior Publication Data

US 2011/0156965 A1 Jun. 30, 2011

(30) Foreign Application Priority Data

Dec. 25, 2009 (TW) ..... 98144871 A

(51) Int. Cl.
*H01Q 1/24* (2006.01)
*H01Q 3/24* (2006.01)
*H01Q 1/50* (2006.01)

(52) U.S. Cl.
USPC ..... 343/702; 343/876; 343/906

(58) Field of Classification Search
USPC ..... 343/702, 872, 876, 906; 455/572.1, 455/572.3, 572.4, 572.7
See application file for complete search history.

(56) References Cited

U.S. PATENT DOCUMENTS

2009/0224982 A1* 9/2009 Isoda et al. ..... 343/702

* cited by examiner

*Primary Examiner* — Robert Karacsony
(74) *Attorney, Agent, or Firm* — Altis Law Group, Inc.

(57) ABSTRACT

A wireless communication device includes a main body, a cover, a base board, an elastic member, and an antenna module. The cover is attached to the main body. The base board includes a feeding point and a grounding point. The elastic member is connected to one of the feeding point and the grounding point. The antenna module includes a first antenna and a second antenna connected to the other feeding point and the grounding point of the base board. The base board, the elastic and the antenna module are mounted in the cover. The elastic member selectively causes the first antenna or the second antenna to contact to the one of the feeding points and the grounding point of the base board when in an open or closed state.

20 Claims, 7 Drawing Sheets

WIRELESS COMMUNICATION DEVICE

BACKGROUND

1. Technical Field

The disclosure generally relates to wireless communication devices, particularly to a wireless communication device for reducing frequency shift.

2. Description of Related Art

Antennas are usually assembled in a portable wireless communication device to send and/or receive signals. However, the antennas are susceptible to interference from electromagnetic waves generated by other electronic members such as a speaker, or a camera. Therefore, a frequency shift may occur when a flip-type wireless communication device converts from a closed state to an open state, or vice versa, because of different intensity interferences. Communication qualities of the portable wireless communication device will be affected as a result.

Therefore, there is room for improvement within the art.

BRIEF DESCRIPTION OF THE DRAWINGS

Many aspects of the wireless communication device can be better understood with reference to the following drawings. The components in the drawings are not necessarily drawn to scale, the emphasis instead being placed upon clearly illustrating the principles of the wireless communication device.

DETAILED DESCRIPTION

Figure 1:
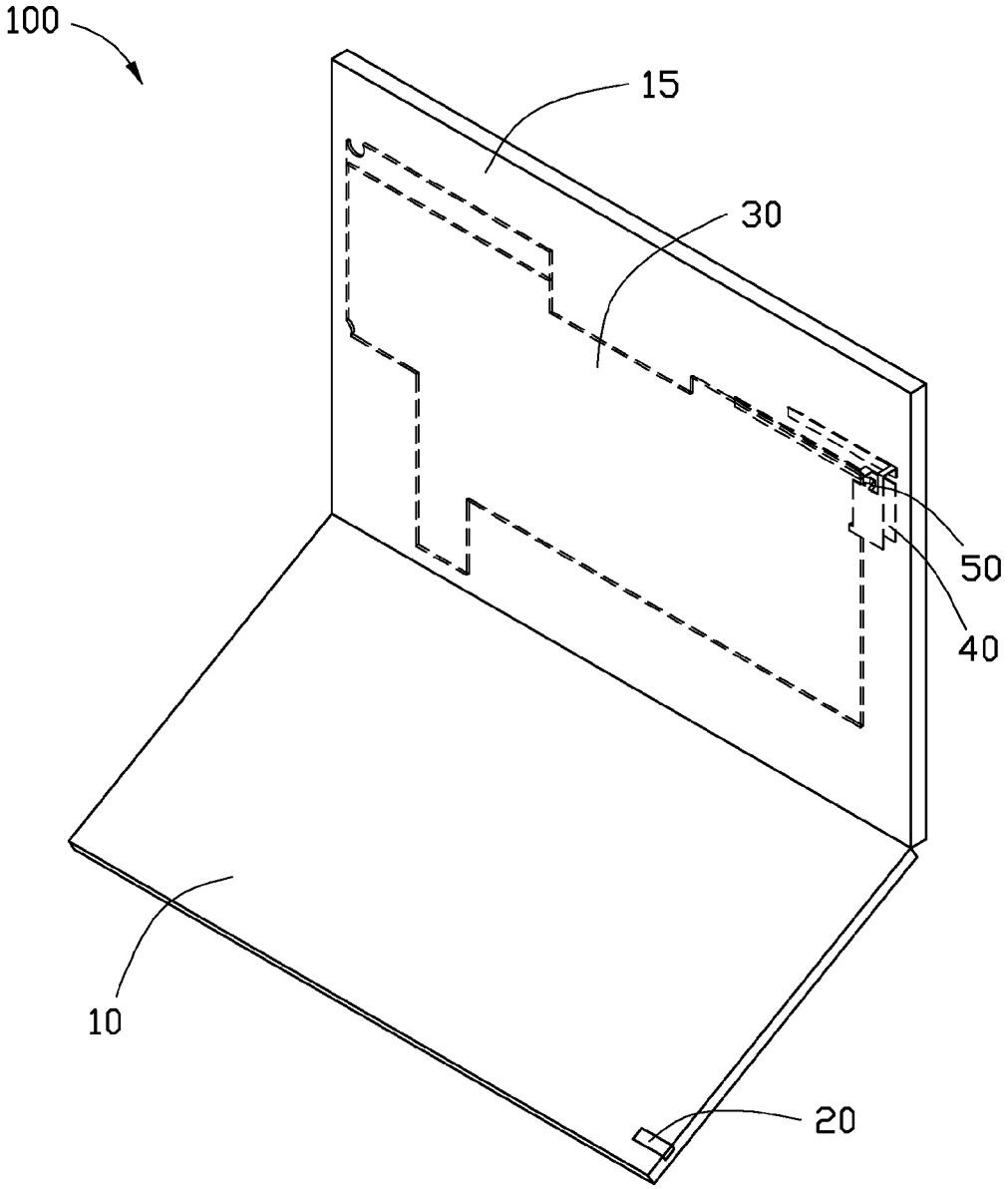
FIG. 1 is a schematic view of a wireless communication device in an opened state, according to an exemplary embodiment.

Referring to FIG. 1, a wireless communication device 100, such as a mobile phone or a personal digital assistant (PDA), includes a main body 10, a cover 15, an attracting member 20, a base board 30, an antenna module 40 and an elastic member 50.

Figure 2:
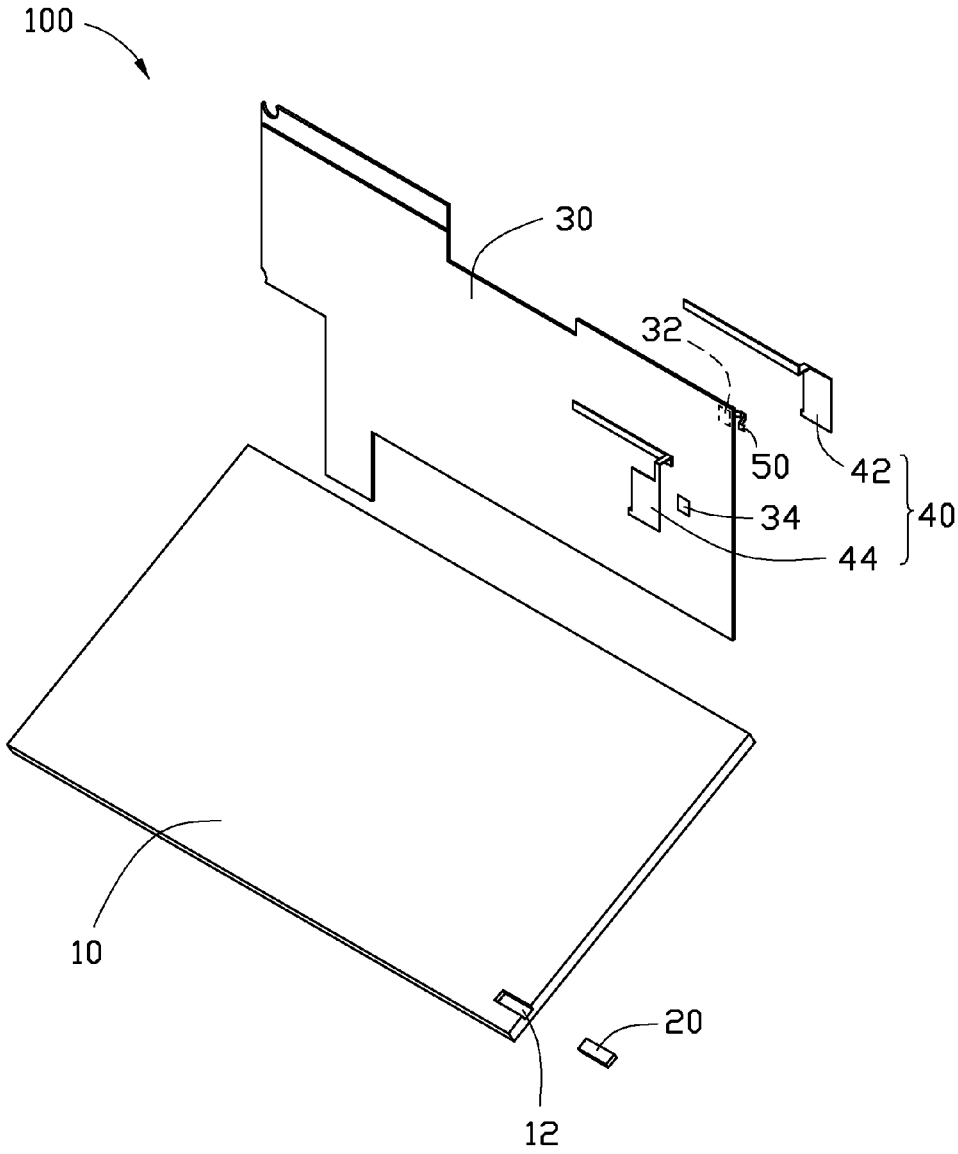
FIG. 2 is a disassembled schematic view of the wireless communication device of FIG. 1.

Referring to FIG. 2, the main body 10 is a housing of the wireless communication device 100 and defines a receiving notch 12 at one corner thereof. The cover 15 is rotatably attached to the main body 10. The attracting member 20 may be a magnet. The attracting member 20 is received in the receiving notch 12. The base board 30 is a flexible printed circuit board (FPCB) including a feeding point 32 and a grounding point 34

Figure 3:
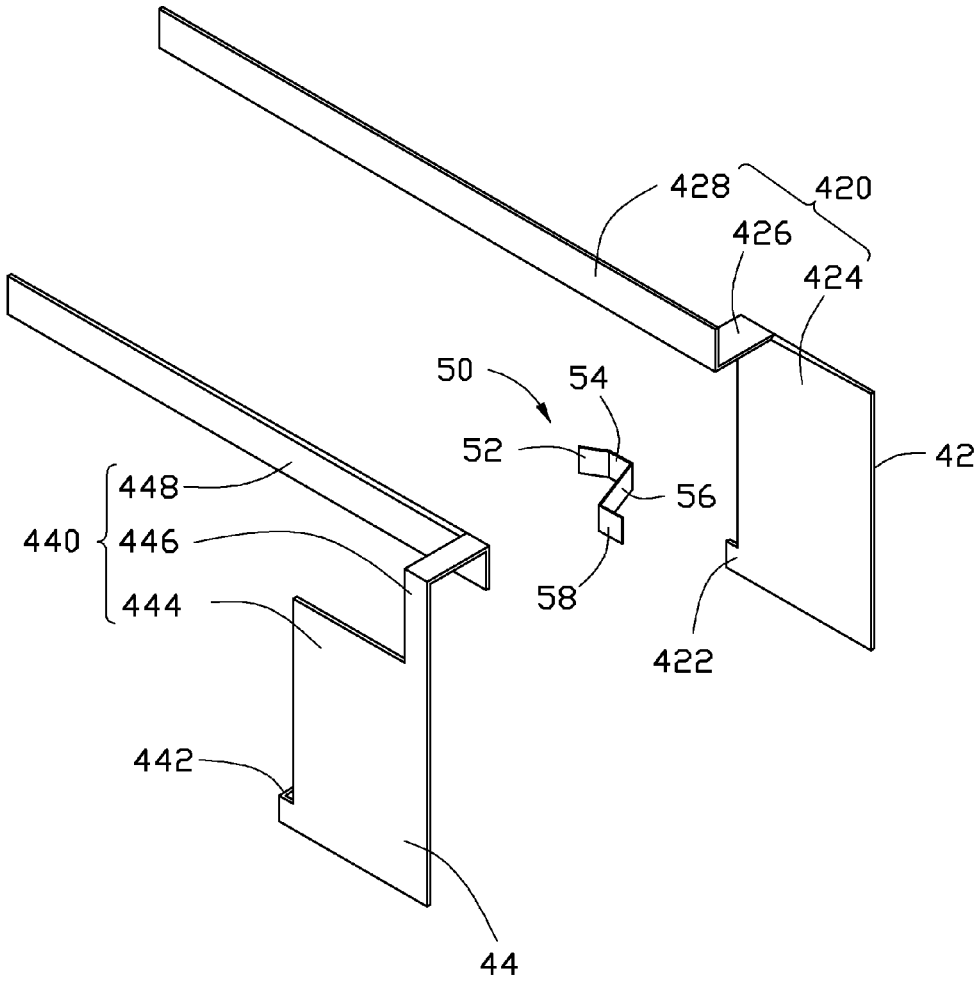
FIG. 3 is a disassembled schematic view of an antenna module and an elastic member of the wireless communication device of FIG. 1.
Figure 4:
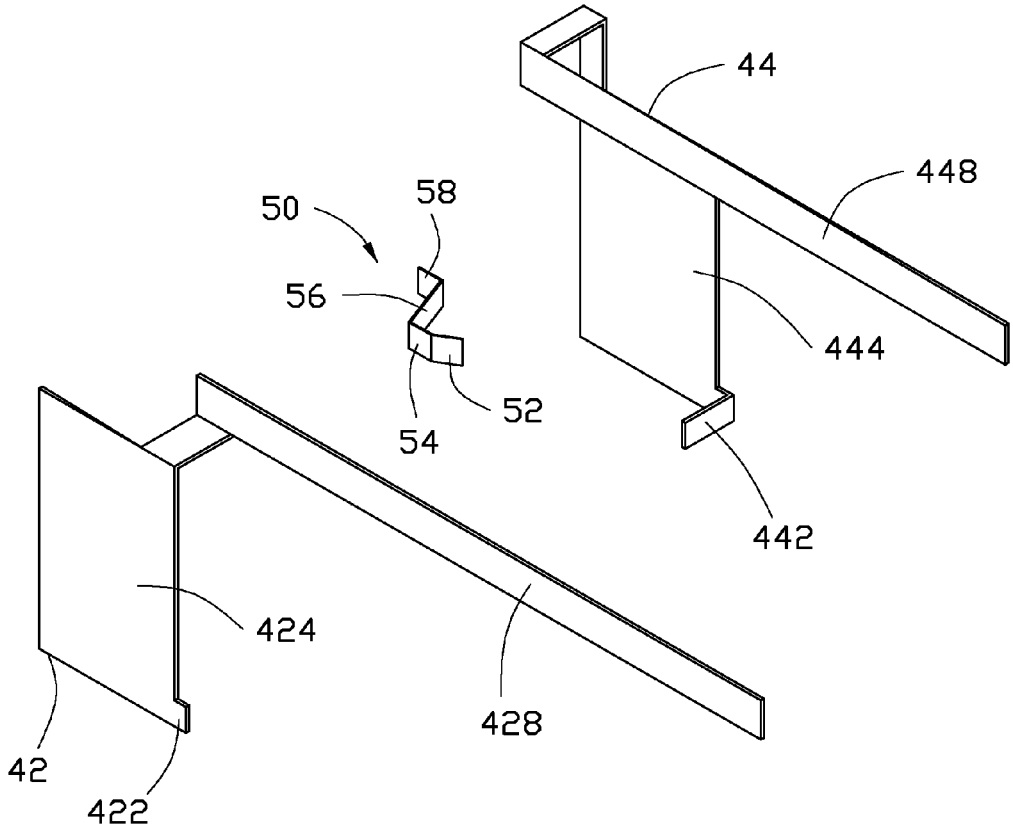
FIG. 4 is similar to FIG. 3, but shown from another aspect.

Referring to FIG. 3 and FIG. 4, the antenna module 40 includes a first antenna 42 and a second antenna 44. The first antenna 42 includes a first radiating body 420 and a first grounding end 422. The first radiating body 420 includes a first main portion 424, a first connecting portion 426, and a first extending portion 428. The first main portion 424 is substantially a rectangular sheet. One end of the first connecting portion 426 perpendicularly connects to the first main portion 424 at one edge thereof. Another end of the first connecting portion 426 perpendicularly connects the first extending portion 428. The first extending portion 428 is a strip-shaped sheet. The first extending portion 428 and the first main portion 424 are substantially parallel and symmetrically positioned at opposite sides of the first connecting portion 426. The first grounding end 422 extends from an edge of the main portion 424 opposite to the first connecting portion 426, and connects to the grounding point 34 of the base board 30.

The second antenna 44 includes a second radiating body 440 and a second grounding end 442. The second radiating body 440 includes a second main portion 444, a second connecting portion 446, and an extending portion 448. The second main portion 444 is similar to the first main portion 424. In this exemplary embodiment, the second main portion 444 has substantially the same dimensions as the first main portion 424. The second connecting portion 446 is substantially an L-shaped sheet. Two ends of the second connecting portion 446 respectively connect to the second main portion 444 and the second extending portion 448. The second extending portion 448 is a strip-shaped sheet which is substantially parallel to and facing toward the second main portion 444. The length of the second extending portion 448 is smaller than that of the first extending portion 428. The second grounding end 442 is substantially an L-shaped sheet connecting to one side of the second main portion 444 opposite to the second extending portion 448.

Figure 5:
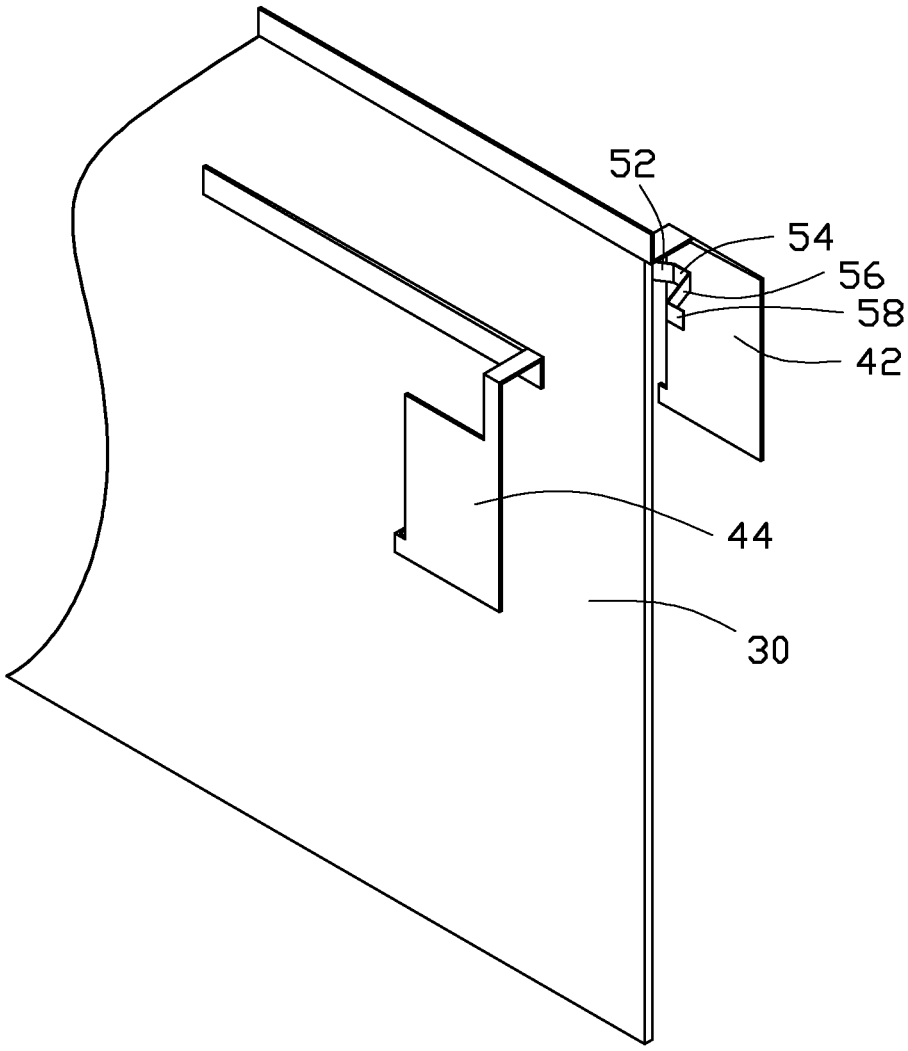
FIG. 5 is a schematic view of the antenna module and the elastic member of the wireless communication device of FIG. 1, when the elastic member is in an original state.

The elastic member 50 is substantially a zigzag metal sheet including a fixing portion 52, a first contact portion 54, a bent portion 56 and a second contact portion 58 connected in series. The fixing portion 52 is secured on the base board 30 and connects to the feeding point 32. The first contact portion 54, the bent portion 56 and the second contact portion 58 extend away from one edge of the base board 30. Referring to FIG. 5, in an original state, the first contact portion 54 contacts the first main portion 424 of the first antenna 42; the second contact portion 58 is positioned between the first antenna 42 and the second antenna 44 and separate from both of them.

Figure 6:
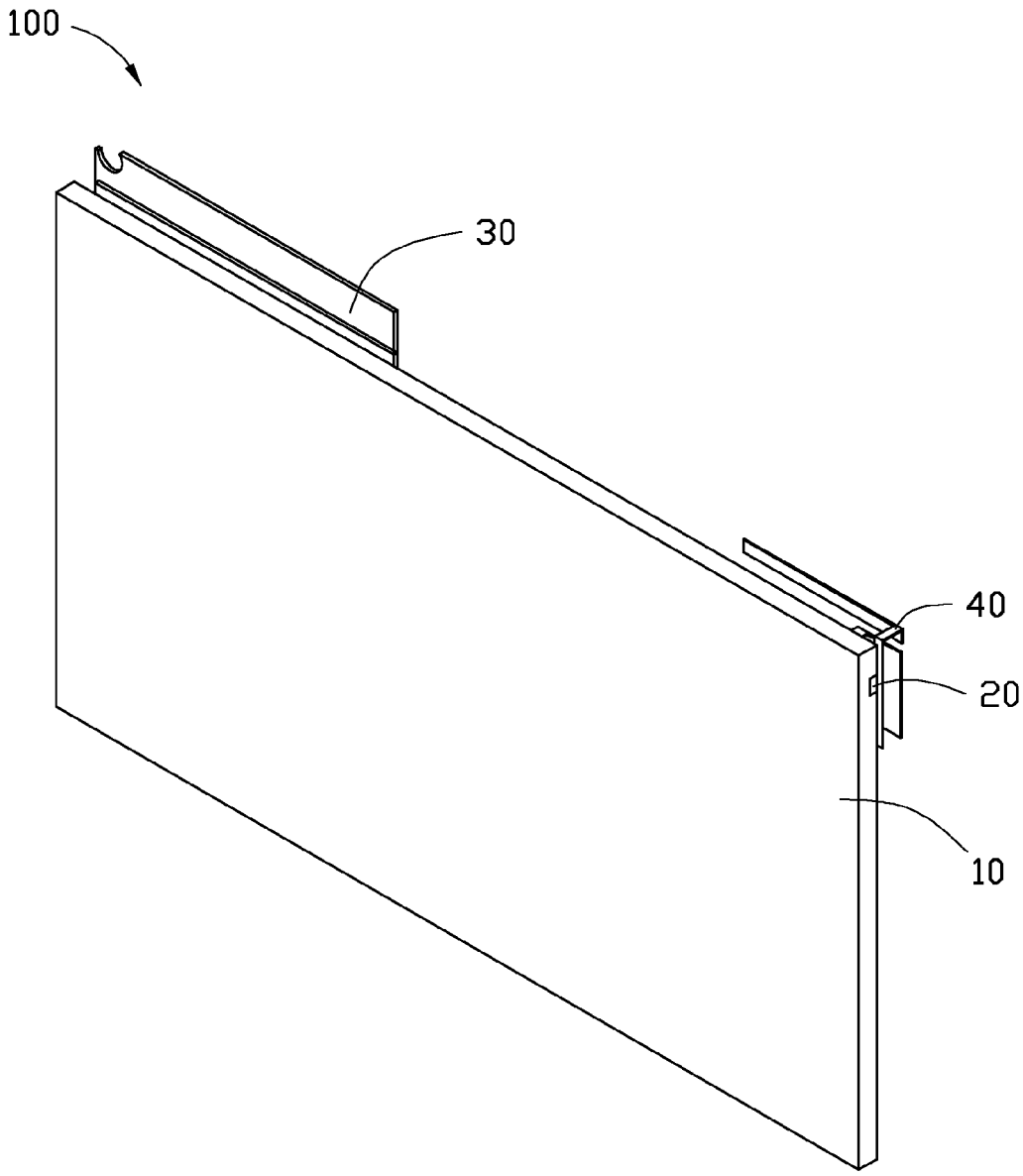
FIG. 6 is a schematic view of the wireless communication device of FIG. 1 in a closed state.
Figure 7:
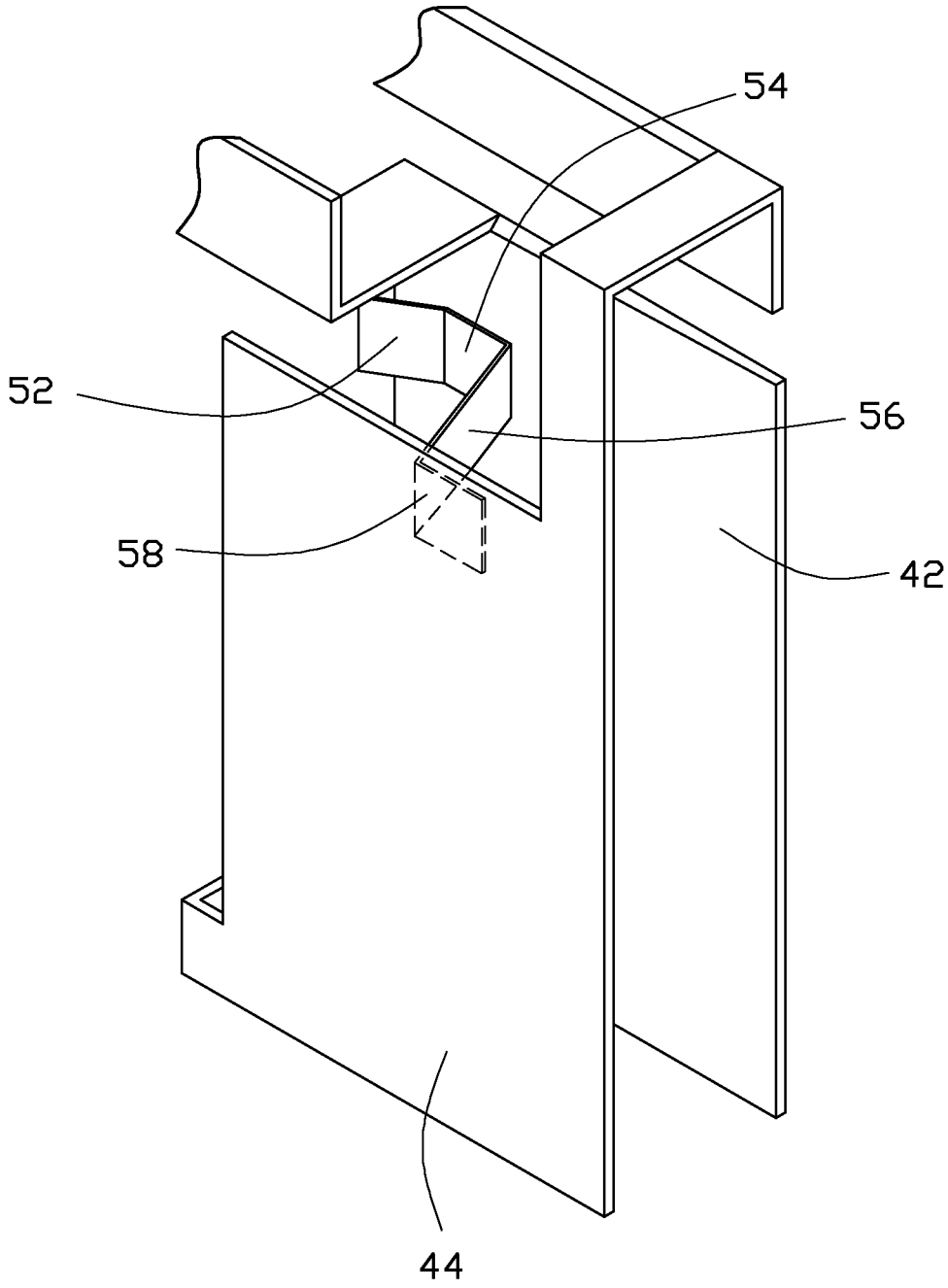
FIG. 7 is a schematic view of the antenna module and the elastic member of the wireless communication device of FIG. 5, and the elastic member is deformed.

Referring to FIGS. 6 and 7, to assemble the wireless communication device 100, the attracting member 20 is received in the receiving notch 12. The first grounding end 422 of the first antenna 42 and the second grounding end 442 of the second antenna 44 connect to the grounding point 34 of the base board 30 and are symmetrically positioned at opposite sides of the base board 30. The fixing portion 52 of the elastic member 50 is secured to the feeding point 32 of the base board 30. The base board 30, the antenna module 40 and the elastic member 50 are mounted in the cover 15. Finally, the cover 15 is attached to the main body 10.

When in an open state, the elastic member 50 is in the original state, the first contact portion 54 of the elastic member 50 contacts the first main portion 424 of the first antenna 42. The antenna module 40 forms a first current path from the fixing portion 52 to the first grounding end 422 by the first radiating body 420 which is suitable for the open state. Referring to FIG. 7, when in a closed state, the attracting member 40 attracts the elastic member 50 toward the second antenna 44. The elastic member 50 deforms until the second contact portion 58 contacts the second main portion 444 of the second antenna 44. The first current path is broken and the antenna module 40 forms a second current path from the fixing portion 52 to the second grounding end 442 by the second radiating body 440. Because the length of the second extending portion 448 of the second radiating body 440 is smaller than that of the first extending portion 428, the second current path is shorter than the first current path and more suitable for the closed state. To unfold the wireless communication device 100, the attracting member 40 is moved away from the cover 15, and the elastic member 50 returns back to its original state. The first contact portion 54 of the elastic member 50 contacts the first main portion 424 of the first antenna 42.

The wireless communication device 100 selectively causes the first antenna 42 or the second antenna 44 suitable for the open or closed state adjusted by the elastic member 50 and obtains a stable and desired frequency to avoid a frequency shift.

In other embodiments, the fixing portion 52 of the elastic member 50 can be secured at the grounding point 34 of the base board 30. The first grounding end 422 of the first antenna 42 and the second grounding end 442 of the second antenna 44 can be selectively chosen to contact to the grounding point 34 of the base board 30 for different states.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A wireless communication device, comprising:

a main body;

a cover attached to the main body and having open and closed states;

a base board including a feeding point and a grounding point;

an elastic member connected to one of the feeding point and the grounding point; and an antenna module including a first antenna positioned at one side of the base board and a second antenna positioned at other side of the base board opposite to the first antenna, the first antenna and the second antenna connected to the other of the feeding point and the grounding point of the base board; wherein the base board, the elastic member and the antenna module are mounted in the cover; the elastic member is positioned between the first antenna and the second antenna, and selectively causes the first antenna or the second antenna to connect with the one of the feeding point and the grounding point of the base board when the cover is in its open or closed state, respectively.

2. The wireless communication device as claimed in claim 1, wherein the first antenna and the second antenna are connected to the grounding point; the elastic member is connected to the feeding point and selectively causes the first antenna or the second antenna to contact the feeding point when in the open or closed state.

3. The wireless communication device as claimed in claim 2, wherein the elastic member includes a fixing portion, a first contact portion, a bent portion and a second contact portion connected in series, the fixing portion secured on the base board and connected to the feeding point, the first contact portion and the second contact portion causes the first antenna or the second antenna to contact to the feeding point.

4. The wireless communication device as claimed in claim 3, wherein the first contact portion, the bent portion and the second contact portion are extended from one edge of the base board and are between the first antenna and the second antenna.

5. The wireless communication device as claimed in claim 3, further comprising an attracting member received in the main body, when the wireless communication device in closed state, the attracting member attracts the second contact portion toward the main body to contact the second antenna.

6. The wireless communication device as claimed in claim 3, wherein the elastic member is a zigzag metal sheet.

7. The wireless communication device as claimed in claim 1, wherein the first antenna includes a first radiating body and a first grounding end; the second antenna includes a second radiating body and a second grounding end; the first grounding end and the second grounding end are connected to the ground point; the first radiating body and the second radiating body can selectively contact the elastic member.

8. The wireless communication device as claimed in claim 7, wherein the first radiating body includes a first main portion, a first extending portion, and a first connecting portion connecting the first main portion and the first extending portion; the second radiating body includes a second main portion, a second extending portion and a second connecting portion connecting the second main portion and second extending portion; the length of the second extending portion is smaller than that of the first extending portion.

9. The wireless communication device as claimed in claim 1, wherein the first antenna and the second antenna are connected to the feeding point;

the elastic member is connected to the grounding point and selectively causes the first antenna or the second antenna to contact to the grounding point when the cover is in its open or closed state.

10. The wireless communication device as claimed in claim 9, wherein the elastic member includes a fixing portion, a first contact portion, a bent portion and a second contact portion connected in series, the fixing portion is secured on the base board and connected to the grounding point, the first contact portion and the second contact portion causes the first antenna or the second antenna to contact to the grounding point.

11. The wireless communication device as claimed in claim 10, wherein the first contact portion, a bent portion and a second contact portion are extended from one edge of the base board and are between the first antenna and the second antenna.

12. The wireless communication device as claimed in claim 10, further comprising an attracting member received in the main body, when the wireless communication device in the closed state, the attracting member attracts the second contact portion toward the main body to contact the second antenna.

13. The wireless communication device as claimed in claim 12, wherein the elastic member is a zigzag metal sheet.

14. The wireless communication device as claimed in claim 9, wherein the first antenna includes a first radiating body and a first grounding end; the second antenna includes a second radiating body and a second grounding end; the first grounding end and the second grounding end are connected to the ground point; the first radiating body and the second radiating body can selectively contact to the elastic member.

15. The wireless communication device as claimed in claim 14, wherein the first radiating body includes a first main portion, a first extending portion, and a first connecting portion connecting the first main portion and the first extending portion; the second radiating body includes a second main portion, a second extending portion and a second connecting portion connecting the second main portion and second extending portion; the length of the second extending portion is smaller than that of the first extending portion.

16. A wireless communication device, comprising:

a main body;

a cover rotatably attached to the main body and having open and closed states;

a base board including a feeding point and a grounding point;

an elastic member, the elastic member comprising a fixing portion, a first contact portion, a bent portion and a second contact portion connected in series, the fixing portion secured on the base board and connected to one of the feeding point and the grounding point; and an antenna module including a first antenna and a second antenna connected to the other of the feeding point and the grounding point of the base board; wherein the base board, the elastic member and the antenna module are mounted in the cover; the first contact portion and the second contact portion selectively cause one of the first antenna and the second antenna to contact to the one of the feeding point and the grounding point.

17. The wireless communication device as claimed in claim 16, further comprising an attracting member received in the main body, when the wireless communication device in closed state, the attracting member attracts the second contact portion toward the main body to contact the second antenna.

18. The wireless communication device as claimed in claim 16, wherein the first contact portion, the bent portion and the second contact portion are extended from one edge of the base board and are between the first antenna and the second antenna.

19. A wireless communication device, comprising:

a main body;

a cover rotatably attached to the main body and having open and closed states;

a base board including a feeding point and a grounding point;

an elastic member connected to one of the feeding point and the grounding point; and an antenna module including a first antenna and a second antenna connected to the other of the feeding point and the grounding point of the base board;

an attracting member received in the main body, when the wireless communication device in closed state, the attracting member attracts the second contact portion toward the main body to contact the second antenna;

wherein the base board, the elastic member and the antenna module are mounted in the cover; when the wireless communication device in open state, the elastic member causes the first antenna to contact to the one of the feeding point and the grounding point;

when the wireless communication device in closed state, the attracting member attracts the elastic toward the main body, the elastic member causes the second antenna to contact the one of the feeding point and the grounding point.

20. The wireless communication device as claimed in claim 19, wherein the elastic member includes a fixing portion, a first contact portion, a bent portion and a second contact portion connected in series, the fixing portion secured on the base board and connected to the feeding point, the first contact portion and the second contact portion causes the first antenna or the second antenna to contact to the one of the feeding point and the grounding point.

* * * * *